US008096530B2

(12) United States Patent
Pelfrey

(10) Patent No.: US 8,096,530 B2
(45) Date of Patent: Jan. 17, 2012

(54) FLEXIBLE IMPELLER PUMPS FOR MIXING INDIVIDUAL COMPONENTS

(75) Inventor: Keith A. Pelfrey, Wadsworth, OH (US)

(73) Assignee: GOJO Industries, Inc., Akron, OH (US)

( * ) Notice: Subject to any disclaimer, the term of this patent is extended or adjusted under 35 U.S.C. 154(b) by 1007 days.

(21) Appl. No.: 12/070,103

(22) Filed: Feb. 15, 2008

(65) Prior Publication Data

US 2008/0203591 A1 Aug. 28, 2008

(51) Int. Cl.
*A47K 5/16* (2006.01)
*F01C 5/02* (2006.01)
*F04C 11/00* (2006.01)

(52) U.S. Cl. ..... 261/28; 222/139; 222/145.5; 417/521

(58) Field of Classification Search ..... 261/28, 261/84; 222/138–140, 145.1, 145.5, 145.6, 222/255; 417/521
See application file for complete search history.

(56) References Cited

U.S. PATENT DOCUMENTS

| | | | | |
|---|---|---|---|---|
| 3,014,429 | A | 1/1939 | Doble | |
| 2,856,859 | A | 1/1955 | Baade | |
| 2,902,935 | A | 5/1957 | Dinnison | |
| 5,599,171 | A | 2/1997 | Horwitz | |
| 5,836,482 | A | 11/1998 | Ophardt | |
| 2005/0139612 | A1 | 6/2005 | Matthews | |
| 2006/0011655 | A1 | 1/2006 | Ophardt | |
| 2006/0278657 | A1 | 12/2006 | Roatis | |
| 2008/0277421 | A1 * | 11/2008 | Zlatic et al. | 222/136 |

FOREIGN PATENT DOCUMENTS

| | | |
|---|---|---|
| CN | 1 210 167 | 3/1999 |
| DE | 10 2004 01604 | 10/2005 |
| EP | 0 108 312 | 5/1984 |
| EP | 0 533 983 | 3/1993 |
| GB | 2 212 862 | 8/1989 |
| JP | 07 023876 | 1/1995 |

OTHER PUBLICATIONS

English translation of Office Action from Chinese Application Serial No. 200880009106.0, Dec. 20, 2010, 2 pages.

* cited by examiner

*Primary Examiner* — Frank Lawrence, Jr.
(74) *Attorney, Agent, or Firm* — Calfee, Halter & Griswold LLP

(57) ABSTRACT

A flexible impeller pump includes first and second component housings. The first component housing includes a first flexible impeller and the second component housing includes a second flexible impeller. As these impellers rotate within their respective housings, they draw in and expel individual components into a common receiving chamber. In a particular application, one component is a foamable liquid, and the other component is air, and a mixture of foamable liquid and air is thus created in the common receiving chamber.

11 Claims, 5 Drawing Sheets

FLEXIBLE IMPELLER PUMPS FOR MIXING INDIVIDUAL COMPONENTS

TECHNICAL FIELD

This invention relates to flexible impeller pumps that mix individual components. In particular embodiments, this invention relates to a foam pump that connects to a foamable liquid container and mixes foamable liquid with air, the foam pump being based upon a flexible impeller pump design.

BACKGROUND OF THE INVENTION

While flexible impeller pumps are generally known in the art to be employed for the movement of materials, it is believed that their use for the mixing of two components has not been investigated. Thus, a need exists in the art for a flexible impeller pump assembly that serves to mix and advance two or more components though a common pathway.

There are many applications that involve the mixing of two or more components to achieve a desired end product, and it will become apparent from the present disclosure how the invention herein will be applicable to various procedures and processes involving such mixing. However, without limitation, the present disclosure focuses upon the mixing of a foamable liquid and air to create a foam product. The particular focus is on producing foam products for personal hygiene, such as foam soap and foam skin sanitizer.

SUMMARY OF THE INVENTION

In general, this invention provides a multi-component flexible impeller pump for advancing a first component and a second component through a common pathway. The multi-component flexible impeller pump includes a first component impeller pump having a first component housing with an inlet and an outlet for the passage of the first component. A first component impeller is received to rotate within the first component housing, wherein the rotation of the first component impeller draws the first component into the first component housing through the inlet and forces the first component out of the first component housing through the outlet. The outlet of the first component housing communicates with a common receiving chamber. The multi-component flexible impeller pump further includes a second component impeller pump having a second component housing with an inlet and an outlet for the passage of the second component. A second component impeller is received to rotate within the second component housing, wherein the rotation of the second component impeller draws the second component into the second component housing through the inlet and forces the second component out of the second component housing through the outlet. The outlet of the second component housing communicates with the common receiving chamber, such that the first and second components mix at the common receiving chamber.

In a particular embodiment, a primary drive member is keyed to the first component impeller and the second component impeller, such that, when the primary drive member is driven, both the first component impeller and the second component impeller are caused to rotate within their respective first and second component housings.

In a specific embodiment, this invention provides a foam pump comprising a foamable liquid impeller pump and an air impeller pump. The foamable liquid impeller pump includes a foamable liquid housing having an inlet and an outlet, and a foamable liquid impeller received to rotate within the foamable liquid housing. The inlet communicates with a source of foamable liquid and the outlet communicates with a common receiving chamber. The rotation of the foamable liquid impeller draws foamable liquid from the source of foamable liquid into the foamable liquid housing, through the inlet, and forces foamable liquid out of the foamable liquid housing, through the outlet. The air impeller pump includes an air housing having an inlet and an outlet, and an air impeller received to rotate within the air housing. The inlet communicates with a source of air and the outlet communicates with the common receiving chamber. The rotation of the air impeller draws air into the air housing through the inlet and forces air out of the air housing through the outlet. The foamable liquid and air mix at the common receiving chamber.

This specific embodiment may also be practiced with a primary drive member keyed to the foamable liquid impeller and the air impeller, such that, when the primary drive member is driven, both the foamable liquid impeller and the air impeller are caused to rotate within their respective foamable liquid housing and air housing.

The foamable liquid can be virtually any liquid that will foam upon the introduction of air, as generally disclosed herein. Particularly desired foamable liquids include those for use in personal hygiene, such as foamable liquid soaps and foamable alcohols, particularly for skin sanitizing.

DESCRIPTION OF DRAWINGS

For a complete understanding of the structure and techniques of the invention, reference should be made to the following detailed description and accompanying drawings wherein.

DETAILED DESCRIPTION OF THE INVENTION

Figure 1:
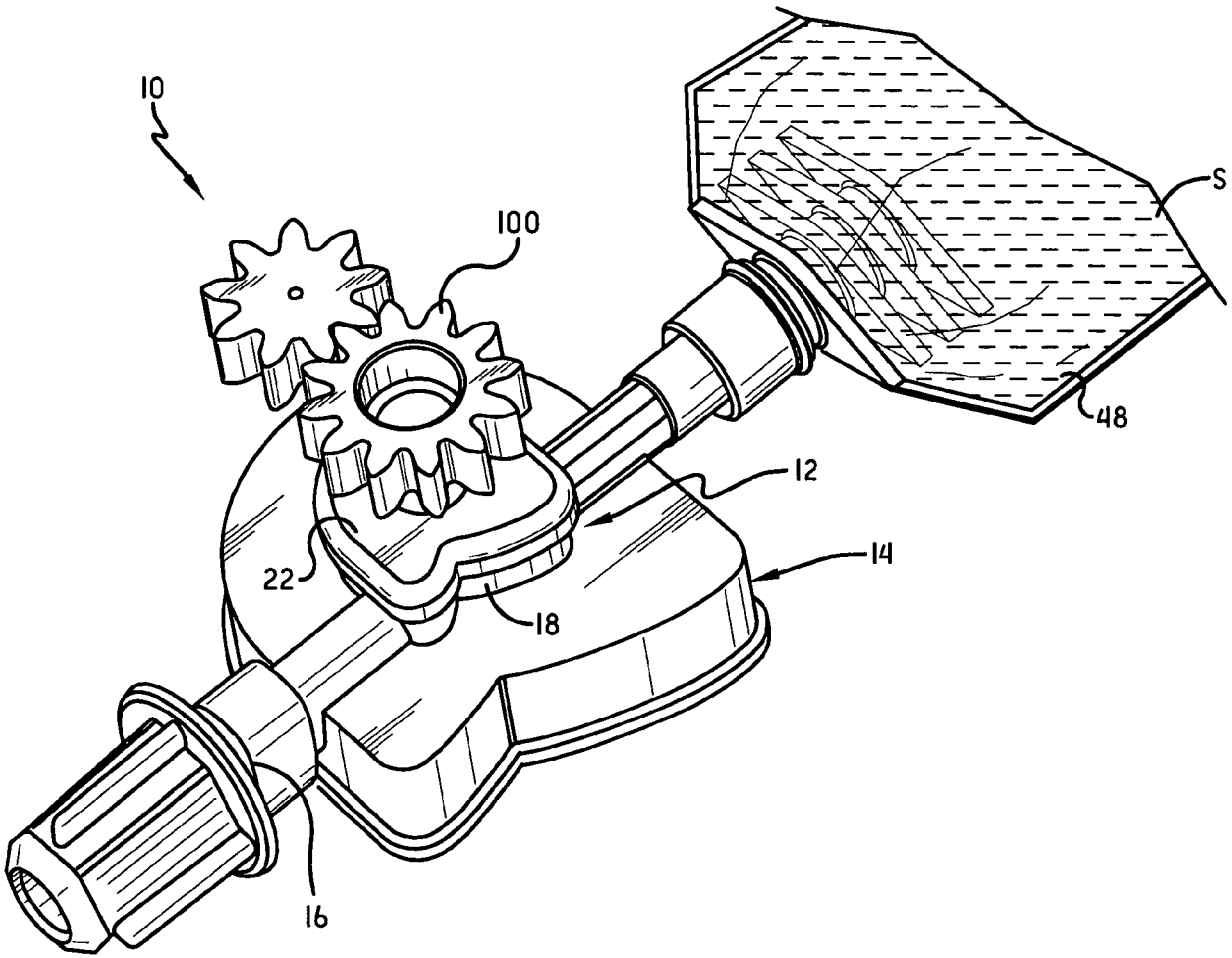
FIG. 1 is a perspective view of a flexible impeller pump in accordance with this invention.

Referring now to FIG. 1, it can be seen that a flexible impeller pump in accordance with this invention is shown designated by the numeral 10. The flexible impeller pump 10 includes a first component impeller pump 12 and a second component impeller pump 14, both of which fluidly communicate with a receiving chamber 16 and move their respective components into receiving chamber 16 to be mixed.

Figure 2:
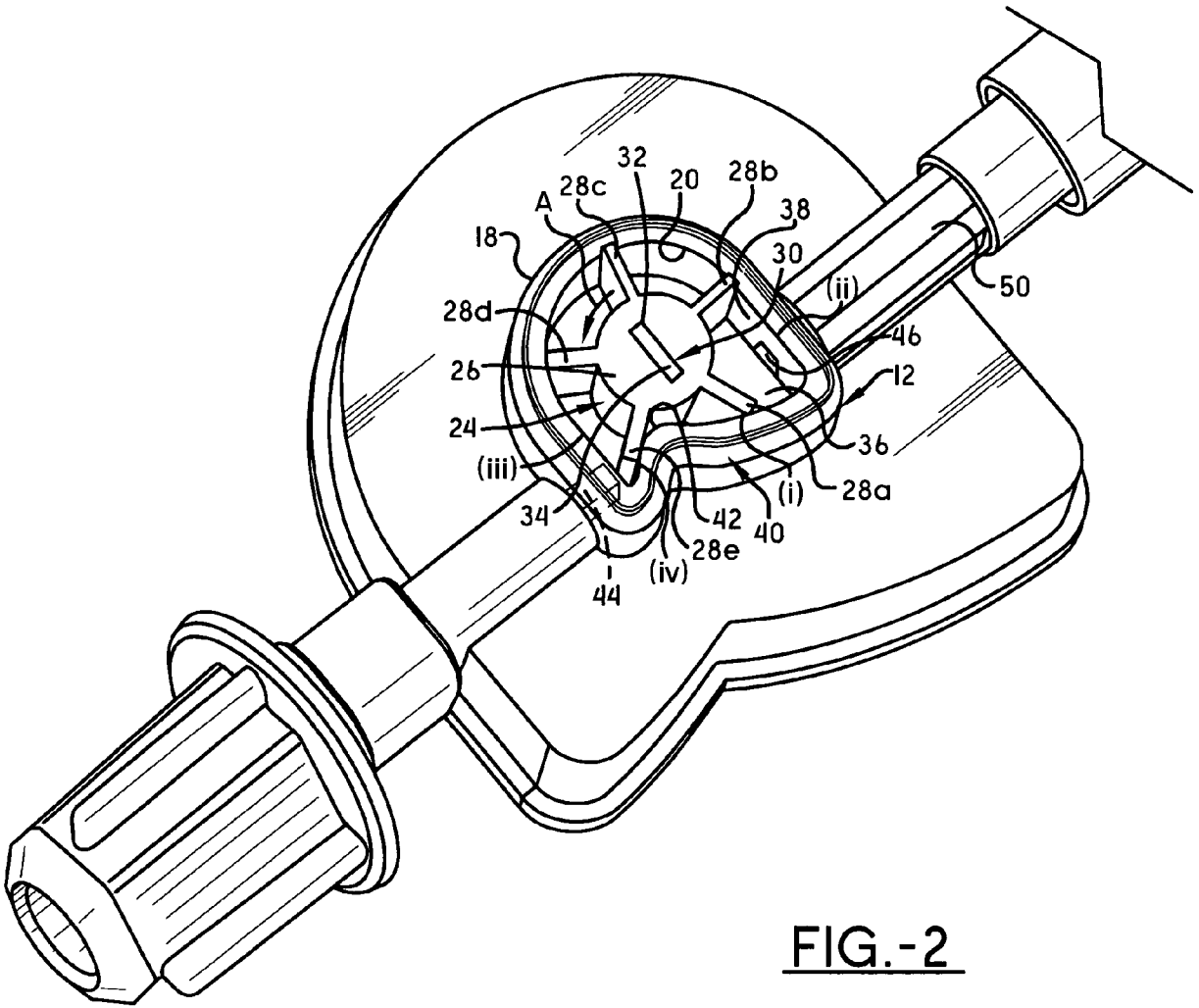
FIG. 2 is a top view showing the first component housing with its cover removed to show the first component impeller and how it operates to advance the first component.

In FIG. 2, the first component impeller pump 12 includes a first component housing 18 having an open end 20 that is sealed with a first housing cover 22 (FIG. 1). A first component impeller 24 is received in the first component housing 18 by inserting it into the first component housing 18 though the open end 20. The first component impeller 24 includes a central hub 26 from which extend a plurality of impeller arms 28*a*, 28*b*, 28*c*, 28*d*, and 28*e*, sometimes collectively or generally referred to herein as impeller arms 28 or impeller arm 28 (when speaking of one arm). The central hub 26 is keyed to a primary drive member 30 that is driven to rotate the first component impeller 24. More particularly, the central hub 26 includes a non-circular aperture 32 that receives a complimentarily shaped first axle portion 34 of primary drive member 30. Thus, as the primary drive member 30 is driven to rotate about its axis X, in the direction of arrow A, the first component impeller 24 rotates within the first housing 18.

The first component housing 18 is defined by a base wall 36, a sidewall 38, and the first housing cover 22. The impeller arms 28 extend to contact the sidewall 38 along most of its length. The sidewall 38 is shaped to cause impeller arms 28 to flex and extend at appropriate locations as they are rotated about axis X in the direction of arrow A. The flexing and extending of the impeller arms 28 causes a first component to be drawn into and expelled out of the first component housing 18. More particularly, the sidewall 38 includes a contoured sidewall portion 40 that causes an impeller arm 28 to increasingly flex as it is rotated past the contour, and then begin to extend to its normal straight shape once it has passed the apex 42 of the contoured sidewall portion 40. Alternatively, the axis of the first component impeller 24 may be positioned off center with respect to a circular first component housing. This alternative structure could be employed to achieve the desired volume expansions and contractions that will be disclosed below.

In the particular embodiment being shown and disclosed, the first component impeller pump 12 is designed to move a non-compressible component, namely a liquid. The second component impeller pump 14 is designed to move a compressible component, namely a gas, particularly ambient air. In a specific embodiment, the liquid is a foamable liquid, and the gas is ambient air, such that a foam product can be produced at receiving chamber 16. Because one pump moves a non-compressible fluid and the other moves a compressible fluid, the design for each pump is different. The disclosure of each design will provide sufficient guidance for adapting the flexible impeller pump 10 to include two non-compressible component pumps or two compressible component pumps rather than the current design having one non-compressible component pump and one compressible component pump. Thus, this invention is not limited to the mixing of one liquid and one gas, and is similarly not limited to only foaming mixtures. Non-foaming mixtures and liquid/liquid and gas/gas mixtures are also contemplated.

In a non-compressible component pump such as the first component impeller pump 12, an impeller arm 28 remains substantially consistent in shape as it is rotated from contact with sidewall 38 at point (i) (the position shown for arm 28*a*) to contact at point (iv) (the position shown for arm 28*e*). Between points (i) and (ii), an impeller arm 28 will not be in contact with the sidewall 38; between points (ii) and (iii), an impeller arm 28 will contact the sidewall with enough force to substantially seal against the sidewall 38; and, between points (iii) and (iv), an impeller arm will again not be in contact with the sidewall 38. The impeller arms 28 adequately seal against the base wall 36 and first housing cover 22.

Upon contact at point (iv) an impeller arm 28 begins to flex as it is further rotated because it must bend around the contoured sidewall portion 40. For example, in the position shown in FIG. 2, it will be appreciated that, as the first component impeller 24 is rotated in the direction of arrow A, the impeller arm 28*e* will begin to flex, and, thus, the volume defined between impeller arm 28*e* and impeller arm 28*d* will begin to decrease. This will force the first component retained between the impeller arms 28*d* and 28*e* to exit the first component housing 18 through outlet 44.

Once impeller arm 28*e* has passed apex 42 it begins to straighten against the contoured sidewall portion 40 of sidewall 38 until it fully straightens at the position (i) shown for impeller arm 28*a*. Continued rotation of the first component impeller 24 will cause the impeller arm at position (i) to move through a free space where it does not contact the sidewall 38, until it comes into contact with the sidewall 38 at contact point (ii). The contact point (ii) is positioned circumferentially beyond an inlet 46, in the direction of rotation of the first component impeller 24. With a lead impeller arm 28 in contact at point (ii) and the immediate trailing impeller arm 28 bending around contoured surface portion 40, continued rotation of the first component impeller 24 will cause an increase in volume between those two impeller arms, thus creating a vacuum at the inlet 46, to draw the first component from a first component container 48 through feed tube 50. The inlet 46 is appropriately positioned at an area where the volume defined between neighboring impeller arms 28 expands during rotation in the direction of arrow A.

Because this particular embodiment employs a first component impeller pump 12 for a non-compressible fluid, the volume defined between neighboring impeller arms 28 of the first component impeller 24 should remain substantially constant in the area between points (ii) and (iii), i.e., at those areas where there is no inlet or outlet. When employing an impeller pump for a compressible fluid, volume changes are acceptable, and even desirable for certain purposes, as will become more apparent from the description of the second component impeller pump 14.

Figure 3:
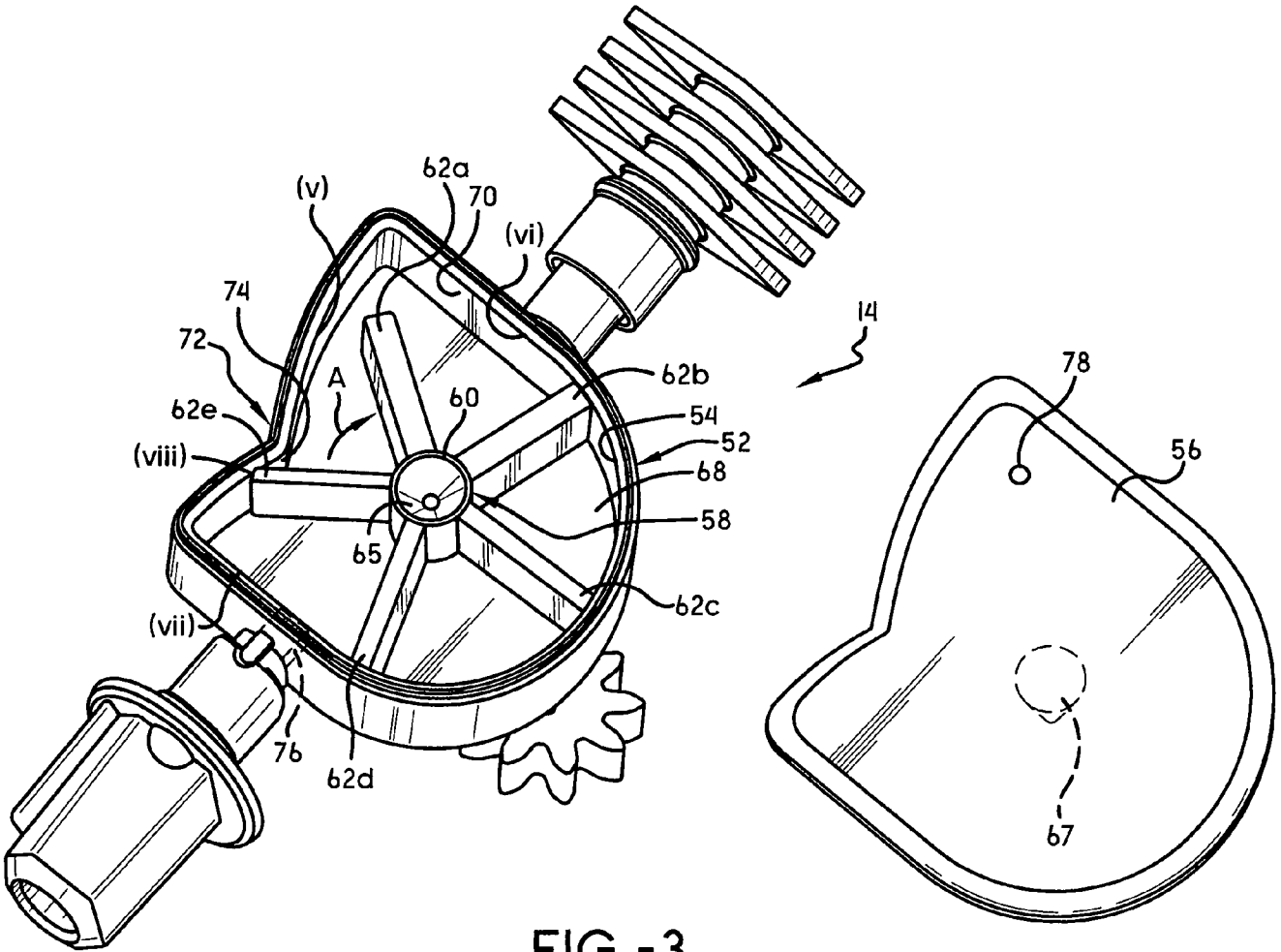
FIG. 3 is a bottom view showing the second component housing with its cover removed to show the second component impeller and how it operates to advance the second component, the cover being shown to the side to help teach the placement of a second component inlet.
Figure 4:
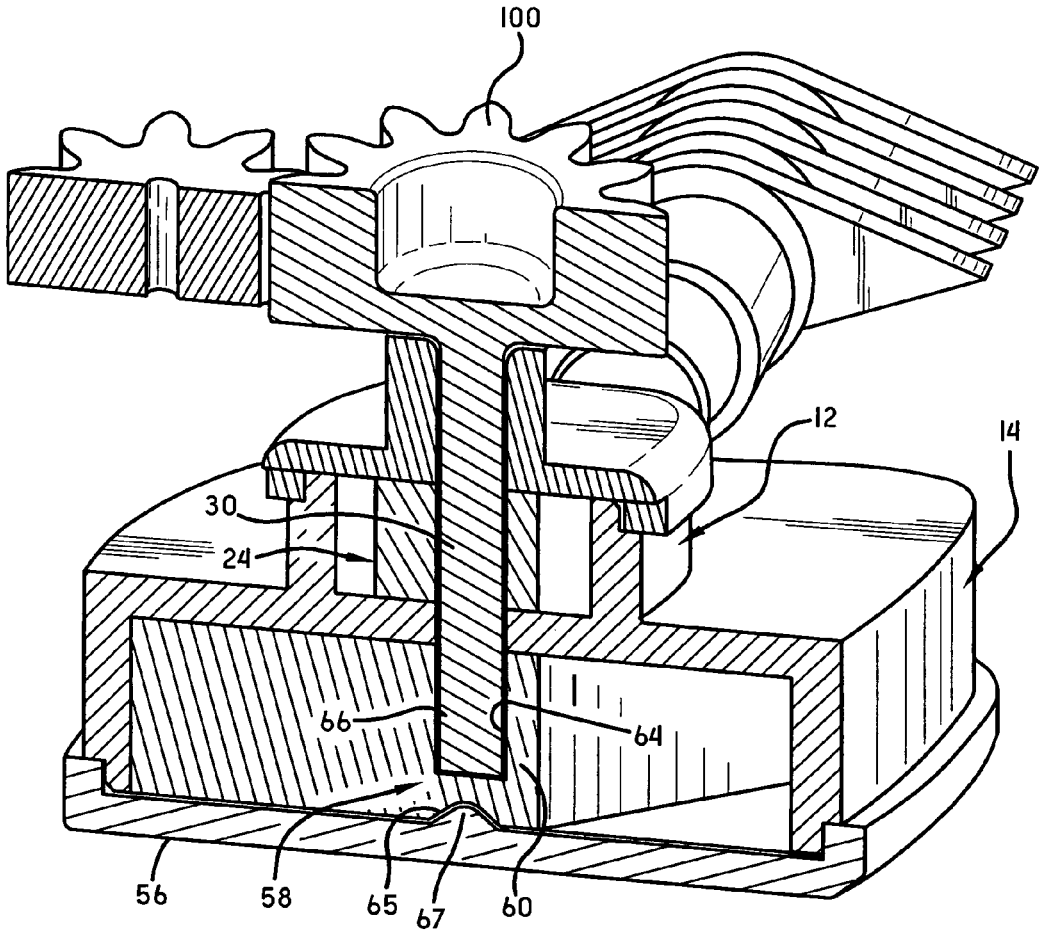
FIG. 4 is a cross section taken through the center of the primary drive member.

Referring now to FIG. 3, the second component impeller pump 14 includes a second component housing 52 having an open end 54 that is sealed with a second housing cover 56. The cover 56 is shown removed and off to the side of the remainder of second component impeller pump 14. How it fits to the whole can be appreciated from the contours of the second component housing 52 and the cover 56 and the illustrations in FIGS. 1 and 3. A second component impeller 58 is received in the second component housing 46 by inserting it in the second component housing 52 through open end 54. The second component impeller 58 includes a central hub 60 from which extend a plurality of impeller arms 62*a*, 62*b*, 62*c*, 62*d* and 62*e*, sometimes collectively or individually referred to herein as impeller arms 62 or impeller arm 62. The central hub 60 is keyed to the primary drive member 30. As seen in FIG. 4, the central hub 60 includes a non-circular cavity 64 that receives a complimentarily shaped second axle portion 66 of the primary drive member 30. This cavity 64 is opposed by a cavity 65 for set pin 67 extending from the cover 56. Thus, as the primary drive member 30 is driven to rotate about its axis X, in the direction of arrow A, the second component impeller 58 rotates within the second component housing 52.

The second component housing 52 is defined by a base wall 68, a sidewall 70, and the second housing cover 56. The impeller arms 62 extend to contact the sidewall 70 along most of its length. The sidewall 70 is shaped to cause impeller arms 62 to flex and extend at appropriate locations as they are rotated about axis X in the direction of arrow A. The flexing and extending of the impeller arms 62 causes a second component to be drawn into and expelled out of the second component housing 52. More particularly, the sidewall 70 includes a contoured sidewall portion 72 that causes an impeller arm 62 to increasingly flex as it is rotated past the contour, and abruptly extend to its normal straight shape once it has passed the apex 74 of the contoured sidewall portion 72.

Alternatively, the axis of the second component impeller 58 may be positioned off center with respect to a circular second component housing. This alternative structure could still be employed to achieve the desired volume expansions and contractions that will be disclosed below.

In this embodiment, the second component impeller pump 14 is designed to move a compressible component, namely a gas, particularly ambient air. In a compressible component pump, an impeller arm 62 need not remain substantially consistent in shape as it is rotated from contact with sidewall 70 at point (v) (the position shown for arm 62*a*) to contact at point (viii) (the position shown for arm 62*e*). Between points (v) and (vi), an impeller arm 62 will not be in contact with the sidewall 70; between points (vi) and (vii), an impeller arm 62 will contact the sidewall 70 with enough force to substantially seal against it; and, between points (vii) and (viii), an impeller arm will again not be in contact with the sidewall 38. The impeller arms 62 also substantially seal against the base wall 68 and second housing cover 56. Upon contact at point (iv) an impeller arm 62 begins to flex as it is further rotated because it must bend around the contoured sidewall portion 72. For example, in the position shown in FIG. 3, it will be appreciated that, as the second component impeller 58 is rotated in the direction of arrow A, the impeller arm 62*e* will begin to flex, and, thus, the volume defined between impeller arm 62*e* and impeller arm 62*d* will begin to decrease. This will force the second component retained between the impeller arms 62*d* and 62*e* to exit the second component housing 52 through outlet 76.

Although it is difficult to see in the figures, for a compressible component pump, the second component housing 52 can be formed with a variable radius such that the volume between two neighboring impeller arms 62 will slightly decease as those arms travel toward outlet 76. In this way, the compressible component can be pressurized so that the built up force pushes the compressible component out through outlet 76. This is particularly beneficial in the specific embodiment herein, where a foam product is produced.

Once impeller arm 62*e* has passed apex 74 and straightened to take up the position shown for impeller arm 62*a*, continued rotation of the second component impeller 58 will cause it to move through a free space until it comes into contact with the sidewall 70 at contact point (vi). The contact point (vi) is positioned circumferentially beyond an inlet 78, in cover 56. With a lead impeller arm 62 in contact at point (vi) and the immediate trailing impeller arm 62 bending around contoured sidewall portion 72, continued rotation of the second component impeller 58 will cause an increase in volume between those two impeller arms, thus creating a vacuum at the inlet 78, to draw the second component G from the ambient atmosphere through second housing cover 56. The inlet 78 is appropriately positioned at an area where the volume defined between neighboring impeller arms 62 expands during rotation in the direction of arrow A. The second component G drawn into the second component housing 52 at inlet 78 is carried between two neighboring impeller arms 56 and forced out of the second component housing 52 at outlet 76, which is placed at an area of volume contraction (i.e., where the volume defined between two neighboring impeller arms 62 is decreasing.

Figure 5:
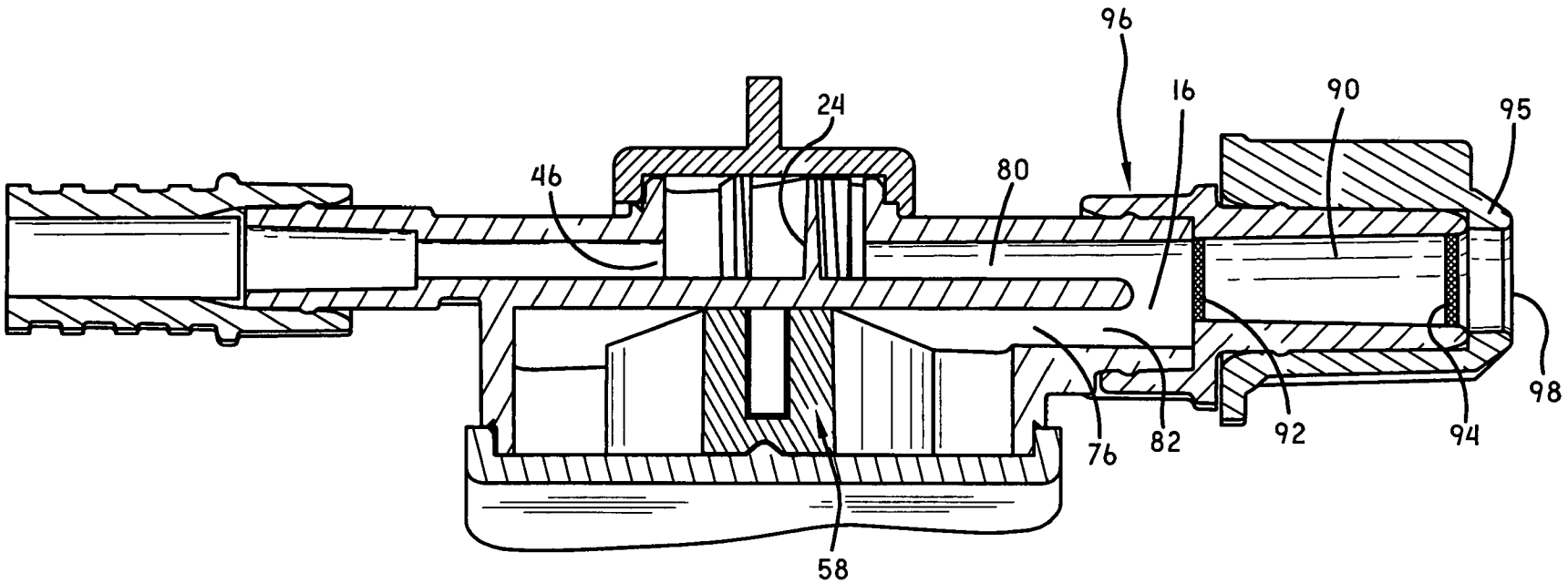
FIG. 5 is a cross section taken through the center of the dispensing tube 96.

It will now be appreciated that driving primary drive member 30 drives both first component impeller 24 and second component impeller 58, and a first component S is drawn from container 48 into first component housing 18 and a second component G is drawn into second component housing 52. Additionally, as seen in FIG. 5, some of the first component S in first component housing 18 is forced out of first component housing 18 through outlet 44 and first component outlet path 80 into the receiving chamber 16, and some of the second component G within second component housing 52 is likewise forced through outlet 76 and second component outlet path 82 into the receiving chamber 16. As a result, the first component S and second component G are mixed to some extent at the receiving chamber 16.

While this rough mixing may be sufficient for some component, for others it might be advisable to employ further structural elements for mixing the components. For instance, in accordance with a specific embodiment of this invention wherein a foam product is made, first component S is a foamable liquid and second component G is air, and the initial mixing at common receiving chamber 16 will usually not be sufficient for providing a quality foam product. Therefore, an optional mixing chamber 90 is provided down stream of the receiving chamber 16. The mixing chamber 90 is preferably bounded by an inlet mesh 92 and an outlet mesh 94 such that first and second components (e.g. foamable liquid and air) coarsely mixed at receiving chamber 16 are forced through the inlet mesh 92 to further mix and create a more homogenous foam product, and, from there, are forced through the outlet mesh 94 to create yet an even higher quality foam, which can be dispensed through a nozzle 95. The relatively thick and viscous foamable liquid spreads across the inlet mesh 92 and is essentially blown therethough by the pressurized air being moved by the second component impeller pump.

In the embodiment shown in FIG. 1, the outlet paths 80, 82, the receiving chamber 16, and the mixing chamber 90 are part of a dispensing tube 96, and the mixing chamber 90 is advantageously placed proximate an outlet 98 of the dispensing tube 96. It is preferred to form a foam product closer to an outlet so that the pumping mechanism does not have to pump a foam product through significant lengths of tubing, as it is typically more difficult to move a foamed product than to move separate liquid and air components. This is particularly true for foam soaps and foam sanitizers.

In particular embodiments wherein the flexible impeller pump 10 is employed to produce either a foam soap or foam sanitizer, the flexible impeller pump 10 is likely to be employed in wall-mounted dispenser systems or counter-mounted dispenser systems, both of which are generally known in the art. In a wall-mounted dispenser system, dispensing tube 96 can remain quite short, with little distance between the initial receiving chamber 16 and its neighboring mixing chamber 90. In counter-mounted dispenser environments, the dispensing tube 96 may be very long, with the receiving chamber 16 being considered as that portion proximate the outlets from the first and second component housings. With a long dispensing tube 96, the coarsely mixed components would be forced through the dispensing tube to a mixing chamber 90 proximate the outlet of dispensing tube 96. More particularly, the flexible impeller pump 10 would be retained under a counter, close to a source of foamable liquid soap or foamable alcohol sanitizer held under the counter. The dispensing tube would extend up through both the counter and a dispensing spout near a sink basin. In such an embodiment, the dispensing tube could preferably include separate first and second outlet paths, such as paths 80 and 82, to keep the components separate until directly before the mixing chamber 90.

In the embodiment shown, primary drive member 30 has a gear head 100 that is manipulated to drive primary drive member 30 to drive the first and second component impellers 24, 58. Another gear or similar drive member could be keyed to gear head 100 so as to rotate the same. Ultimately, gear head 100 is associated with some type of actuation mechanism that is actuated by a user to cause the primary drive member 30 to rotate and ultimately bring out the dispensing of the two components. The primary drive member 30 could be driven through manual means or through electronic means.

For instance, a push plate or plunger actuator could be keyed to gear head 100 such that pushing on the push plate or actuator would rotate the gear head 100 and primary drive member 30. Electronic means could be used to rotate primary drive member 30, as, for instance, by employing a touch-free sensor and appropriate electronics to drive primary drive member 30 when the touch-free sensor is tripped. Push plates, plungers, and touch-free sensor actuators are already generally known, particularly in the soap dispensing arts, and their application in this environment will be readily apparent to those of ordinary skill in the art.

If the primary drive member 30 is continuously driven, first and second components will be continuously drawn into and expelled out of their respective impeller pump housings. While this may be appropriate in some applications for the flexible impeller pump 10, it is envisioned that, in some embodiments, as, for instance, in the creation of a foam soap, only "doses" of the end product are desired. When this is the case, the primary drive member 30 is preferably only driven for a distance sufficient to expel a desired dose of the mixed product. The distance that the primary drive member 30 will have to be driven will depend upon the desired dose of the mixed product and the amount of the first and second component expelled from their respective housings during rotation of their respective impellers. The size of the first and second component housings and the first and second component housing and the first and second impellers and the contours can be altered to achieve a desired volumetric flow rate for the first and second components.

In a foam soap embodiment using liquid soap as a first component and ambient air as a second component, the first component impeller pump and the second component impeller pump are designed such that the ratio of air to liquid at the mixing chamber is from 30:1 to 3:1. In particular embodiment the ratio may be 20:1 to 5:1, and in other embodiments 12:1 to 8:1.

It should be appreciated that the first and second component impeller pumps 12 and 14 could be configured to be circular, with the axis X for the rotation of the flexible impellers 24, 58 being off center with respect to circular housings 18, 52, although such a configuration can be problematic for moving non compressible fluids. Nevertheless, this invention contemplates causing the flexing and extending of impeller arms in either of the first or second component housings through either method. Also, as already mentioned, this invention is not limited to the mixing of one liquid and one gas, and is similarly not limited to only foaming mixtures. Non-foaming mixtures and liquid/liquid and gas/gas mixtures are also contemplated.

In light of the foregoing, it should be apparent that the present invention provides advantages over the prior art in the provision of flexible impeller pumps and pumps for the mixing of individual components. Although preferred embodiments of this invention have been disclosed as required by the patent rules, it will be appreciated that the invention and concepts herein are not limited to such specific applications. Rather, the following claims serve to define the invention.

What is claimed is:

1. A flexible impeller pump for advancing a first component and a second component to a common pathway comprising:

a first component impeller pump including:

a first component housing having an inlet and an outlet for the passage of the first component, and a first component impeller received to rotate within said first component housing, wherein the rotation of said first component impeller draws the first component into said first component housing through said inlet and forces the first component out of said first component housing through said outlet;

the first component impeller and pump housing designed to move a non-compressible fluid;

a second component impeller pump including:

a second component housing having an inlet and an outlet for the passage of the second component, and a second component impeller received to rotate within said second component housing, the second component impeller having flexible arms wherein the rotation of said second component impeller draws the second component into said second component housing through said inlet and forces the second component out of said second component housing through said outlet;

wherein the second component pump housing is larger than the first component housing; and a common receiving chamber communicating with both the outlet of said first component housing and the outlet of said second component housing, such that the first and second components mix at said common receiving chamber.

2. The flexible impeller pump of claim 1, further comprising:

a primary drive member that drives both said first component impeller and said second component impeller to rotate within their respective first and second component housings.

3. The flexible impeller pump of claim 2, wherein said primary drive member is keyed to said first component impeller and said second component impeller so as to define their axes of rotation, said first and second component impeller pumps being coaxial.

4. The flexible impeller pump of claim 3, wherein said primary drive member is an axle member extending through a hub of said first component impeller and a hub of said second component impeller by extending through a common wall shared by said first component housing and said second component housing.

5. The flexible impeller pump of claim 2, wherein said primary drive member is driven physically by an end user of the flexible impeller pump.

6. The flexible impeller pump of claim 2, wherein the said primary drive member is driven electronically.

7. The flexible impeller pump of claim 1, wherein said first component housing has a side wall, said first component impeller includes a plurality of impeller arms extending from a common impeller hub to contact said side wall, said second component housing has a side wall, and said second component impeller includes a plurality of impeller arms extending from a common second impeller hub to contact said second housing side wall.

8. The flexible impeller pump of claim 7, wherein the axis of rotation for said first component impeller is off center with respect to said side wall of said first component housing, and the axis of rotation for the second component impeller is off center with respect to said side wall of said second component housing.

9. The flexible impeller pump of claim 7, wherein said first component housing is shaped with a contoured sidewall portion such that said first component housing has a variable radius, and said second component housing is shaped with a contoured sidewall portion such that said second component housing has a variable radius.

10. The flexible impeller pump of claim 7, wherein the axis of rotation of said first component impeller is off center with respect to said side wall of said first component housing, and the side wall of said second component housing has a contour such that the said second component housing has a variable radius.

11. A foam pump comprising:

a foamable liquid impeller pump including:

a foamable liquid housing having an inlet and an outlet, said inlet communicating with a source of foamable liquid, and a foamable liquid impeller having flexible arms received to rotate within said foamable liquid housing, wherein the rotation of said foamable liquid impeller draws foamable liquid from said source of foamable liquid into said foamable liquid housing through said inlet and forces foamable liquid out of said foamable liquid housing through said outlet;

an air impeller pump including:

an air housing having an inlet and an outlet, said inlet communicating with a source of air, and an air impeller having flexible arms received to rotate within said air housing, wherein the rotation of said air impeller draws air into said air housing through said inlet and forces air out of said air housing through said outlet;

wherein the foamable liquid housing is smaller than the air housing;

a primary drive member keyed to said foamable liquid impeller and said air impeller, such that, when said primary drive member is driven, both said foamable liquid impeller and said air impeller are caused to rotate within their respective liquid and air housings; and a common receiving chamber communicating with both the outlet of said foamable liquid housing and the outlet of said air component housing, such that air and liquid soap mix at said common receiving chamber.

* * * * *

UNITED STATES PATENT AND TRADEMARK OFFICE

CERTIFICATE OF CORRECTION

PATENT NO. : 8,096,530 B2
APPLICATION NO. : 12/070103
DATED : January 17, 2012
INVENTOR(S) : Keith A. Pelfrey It is certified that error appears in the above-identified patent and that said Letters Patent is hereby corrected as shown below:

On the title page insert item -- (63) Related U.S. Application Data

This application claims the benefit of Provisional Application No. 60/901,775 filed on February 16, 2007--

Signed and Sealed this
Thirteenth Day of March, 2012

David J. Kappos

David J. Kappos
*Director of the United States Patent and Trademark Office*